US005229559A

United States Patent [19]

Siikonen et al.

[11] Patent Number: 5,229,559

[45] Date of Patent: Jul. 20, 1993

[54] DEFINING THE TRAFFIC MODE OF AN ELEVATOR, BASED ON TRAFFIC STATISTICAL DATA AND TRAFFIC TYPE DEFINITIONS

[75] Inventors: Marja-Liisa Siikonen, Helsinki; Timo Korhonen, Hyvinkaa, both of Finland

[73] Assignee: Kone Elevator, Baar, Switzerland

[21] Appl. No.: 612,681

[22] Filed: Nov. 15, 1990

[30] Foreign Application Priority Data

Nov. 15, 1989 [FI] Finland ..... 895449

[51] Int. Cl.[5] ..... B66B 1/20

[52] U.S. Cl. ..... 187/124; 187/127

[58] Field of Search ..... 187/124, 127; 364/513

[56] References Cited

U.S. PATENT DOCUMENTS

| | | | |
|---|---|---|---|
| 3,973,649 | 8/1976 | Iwasaka et al. | 187/127 |
| 4,030,571 | 6/1977 | Kaneko et al. | 187/127 |
| 4,591,985 | 5/1986 | Tsuji | 364/424 |
| 4,760,896 | 8/1988 | Yamaguchi | 187/124 |
| 4,947,965 | 8/1990 | Kuzunuki et al. | 187/127 |
| 4,984,174 | 1/1991 | Yasunobu et al. | 364/513 |
| 5,022,498 | 6/1991 | Sasaki et al. | 187/127 |

FOREIGN PATENT DOCUMENTS

| | | | |
|---|---|---|---|
| 0456265 | 11/1991 | European Pat. Off. | 187/124 |
| 2235311 | 2/1991 | United Kingdom | 187/124 |
| 2245998 | 1/1992 | United Kingdom | 187/124 |

*Primary Examiner*—Steven L. Stephan
*Assistant Examiner*—Thomas M. Dougherty

[57] ABSTRACT

A method for controlling an elevator group in which statistical data on a traffic flow within an elevator group, representing the times, local and total volumes of the traffic, and a number of different traffic types used in a group control are stored in a memory unit belonging to the control system. The traffic flow is divided into two or more traffic components, the relative proportion or different traffic components and the prevailing traffic intensity are deduced from the traffic statistics, the traffic components and traffic intensity, i.e. the traffic factors, are subjected to assumptions whose validity is described by means of membership functions of the factors. A set of rules which correspond to different traffic types are formed from these factors and are assigned values by means of the factors and membership functions, the rule which best describes the prevailing traffic is selected, and the traffic type corresponding to the selected rule is used in the control of the elevator group.

9 Claims, 4 Drawing Sheets

DEFINING THE TRAFFIC MODE OF AN ELEVATOR, BASED ON TRAFFIC STATISTICAL DATA AND TRAFFIC TYPE DEFINITIONS

BACKGROUND OF THE INVENTION

1. Field of the Invention

The present invention relates to a method for the control of the traffic of an elevator group.

2. Description of the Related Prior Art

A major problem to solve in the control of an elevator group includes the detection of the peak traffic condition on the main entrance floor or elsewhere. In conventional elevator group control, a peak traffic condition is detected on the basis of the number of departures of elevators with a full load and of the number of calls. However, this data is often obtained at a stage when the peak traffic condition has been continuing for some time or is already over.

In earlier group control systems, the problem is solved on the basis of the numbers of car calls, landing calls and the car load data. For example, if the number of car calls issued from the main entrance floor exceeds a given limit and the cars departing from there are fully loaded, the situation is interpreted as an up peak traffic condition. Similarly, if the number of down-calls exceeds a certain limit and simultaneously the incoming traffic is low and the number of up-calls is low in comparison, then the situation is recognized as a down peak traffic condition.

Patent publication GB-2129971 proposes a control method in which the characteristic traffic modes are formed daily on the basis of the passenger traffic flow data, from which the future traffic is predicted. The characteristic traffic modes are classified on the basis of the volume of upward and downward passenger traffic and the distribution of the traffic between different floors. The traffic modes learn typical data to be used in the elevator control, e.g. door operation times, probabilities of stopping of the cars, load limiations in upward and downward traffic, energy-saving load etc. Statistics on the traffic modes are updated daily according to the time of day and for different week days. However, the amount of data to be stored is very large and the method is suitable only for that specific environment, not for common group control strategies.

SUMMARY OF THE INVENTION

An object of the present invention is to minimize the drawbacks existing in the prior art. A specific object of the invention is to produce an elevator group control method whereby a control mode suited to the prevailing passenger traffic type is determined in advance, mainly on the basis of statistical data.

Accordingly, a method for controlling an elevator group is provided whereby statistical data on the traffic situation of an elevator group are stored in a memory unit of a control system. The statistical data containing information about local and total volumes of traffic at each moment of time and a set of traffic type definitions used in the group control comprise the following steps: dividing the traffic condition into at least two traffic components; determining on the basis of the statistical data the relative proportions of said traffic components and a prevailing traffic intensity; traffic factors, comprising the traffic components and the traffic intensity are assumed using the statistical data and their validity is described by means of membership functions of the factors; traffic rules, corresponding to different traffic types, are formed from the traffic factors; values are assigned to the traffic rules, according to the traffic factors and the membership functions; a rule corresponding to a traffic type which best describes the prevailing traffic situation is selected; and controlling the elevator group by using a traffic type corresponding to the selected rule is provided.

In the method of the present invention for controlling an elevator group, statistical traffic data for the elevator group, covering the local and total traffic volume at different times, and a number of different traffic type definitions are stored in a memory unit of the control system. In the method of the invention, the traffic condition is divided into two or more, preferably three traffic components: incoming, outgoing and inter-floor traffic. To select a suitable traffic type for the elevator group control, the relative proportions of different traffic components and the prevailing traffic intensity are deduced from the passenger traffic statistics. Next, the traffic components and traffic intensity, i.e. the traffic factors, are subjected to assumptions whose validity is represented by means of membership functions. From these functions, rules describing different traffic types are formed. The values of the membership functions for different factors are determined, whereupon the rule which best describes the prevailing passenger traffic situation is selected. The traffic type corresponding to the selected rule is then used in the control of the elevator group.

"Incoming traffic" refers to the traffic consisting of passengers travelling from one or several entrance floors of the building to other floors. Similarly, "outgoing traffic" refers to the traffic consisting of passengers travelling from the other floors to the entrance floors of the building. All the rest of the passenger traffic in the building belongs to the third category, i.e. inter-floor traffic.

In a preferable solution, the traffic statistics is updated by continuously storing current traffic data in the data base. The storing of data can be performed separately for different days of the week and for certain intervals, e.g. at an interval of 15 minutes or half an hour. Usually the statistics representing the local and total volumes of passenger traffic are based on the information obtained from the car load weighing devices, photocell signals and call buttons. The number of passengers leaving an elevator and of passengers entering an elevator on a given floor is preferably calculated from the changes of car load data during the stop at the floor.

The values of the membership functions preferably vary between (0,1). A zero value of the function means that the assumption has been completely invalid, while the value 1 means that the assumption has been completely valid. Intermediate values between 0 and 1 describe the degree of validity of the assumption.

The traffic type is selected by choosing one of the rules consisting of a combination of assumptions which best describe the prevailing traffic situation. The values for the rules consisting of the membership functions are calculated according to fuzzy logic using logical "AND" and "OR" operators of the Zadeh extension principle, where the operators are based on the min-max method. In the rules, the factors are compared using the AND operator, and the OR operator is used to select the most advantageous rule. Thus, preferably the selected rule is the one for which the lowest membership function has the highest value.

On the basis of the statistics, the probable times of beginning and end of traffic peaks can be fairly accurately predicted, at least in office-type buildings. As no accurate data regarding traffic peaks is obtained from the elevators in advance, the forecast obtained on the basis of statistics facilitates the advance recognition of a peak traffic condition. In the method of the invention, the switch-over from one traffic type to another is effected by making comparisons between the probabilities of the inaccurate data obtained from the elevators and selecting the most probable traffic type. Changes of traffic type will not occur abruptly, because the probability changes of the factors are quite continuous. In an intermediate region, the probability of a given traffic type increases e.g. in a linear fashion and thus the probability of the region within which the traffic type is recognized gradually increases, thereby preventing abrupt changes from one type of traffic to another. The traffic intensity is scaled to the handling capacity of the elevator group, ensuring that the method is suitable for different types of traffic and buildings and also for situations where, for some reason, one or more elevators are not in bank or are added to the group. Since the method searches for a traffic type which best suits the situation represented by the initial data, a slight inaccuracy in the initial data will have no effect, and even moderately large errors will not result in the selection of a completely inappropriate traffic type.

The fuzzy-logic principle adopted in the method of the invention is best suited for the definition of uncertain situations, such as the recognition of the traffic type is. By employing fuzzy logic, the control strategies change from one traffic type to another more smoothly and no oscillation between the strategies will occur. Fuzzy logic is typically employed in expert systems where the conclusions are based on partial information and on information stored in a knowledge base.

Moreover, the method of the invention allows new factors, to be easily included in the system, because information that is difficult to delimit clearly can be flexibly presented using membership functions. Additional information representing a momentary state is easily obtained from detectors, calls, load weighing devices, photocell signals, destination buttons, time of the day, etc. This kind of additional factors can be included in all or some of the rules to be used. An example is that the information obtained from a lobby detector regarding the number of passengers waiting in the lobby is used to determine the presence of an up peak condition. There may be a large, fair, small or zero number of passengers waiting, which typically can be inferred using fuzzy logic.

BRIEF DESCRIPTION OF THE DRAWINGS

In the following, the method of the invention is described in detail, reference being made to the attached drawing, in which.

DETAILED DESCRIPTION

Figure 1:
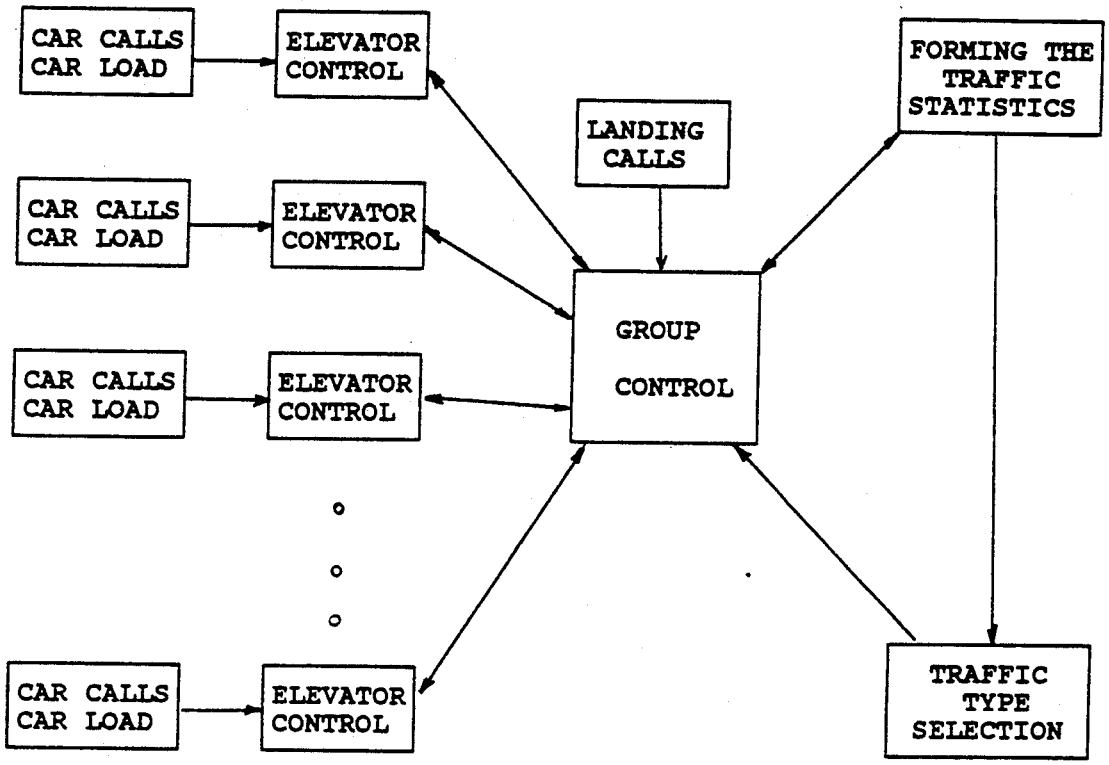
FIG. 1 is a schematic diagram representing the control method of the invention.

As illustrated by FIG. 1, the elevator control systems are connected to the group control board. In practice, the individual elevator control systems and the group control system form an integral whole. Each elevator control system receives the data relating to the car, i.e. car calls and car load. In addition, the group control receives all the landing call data. Based on these data and on other car status data, the traffic statistics is updated, on the basis of which the traffic type best suited for group control in the prevailing conditions is selected.

Figure 2:
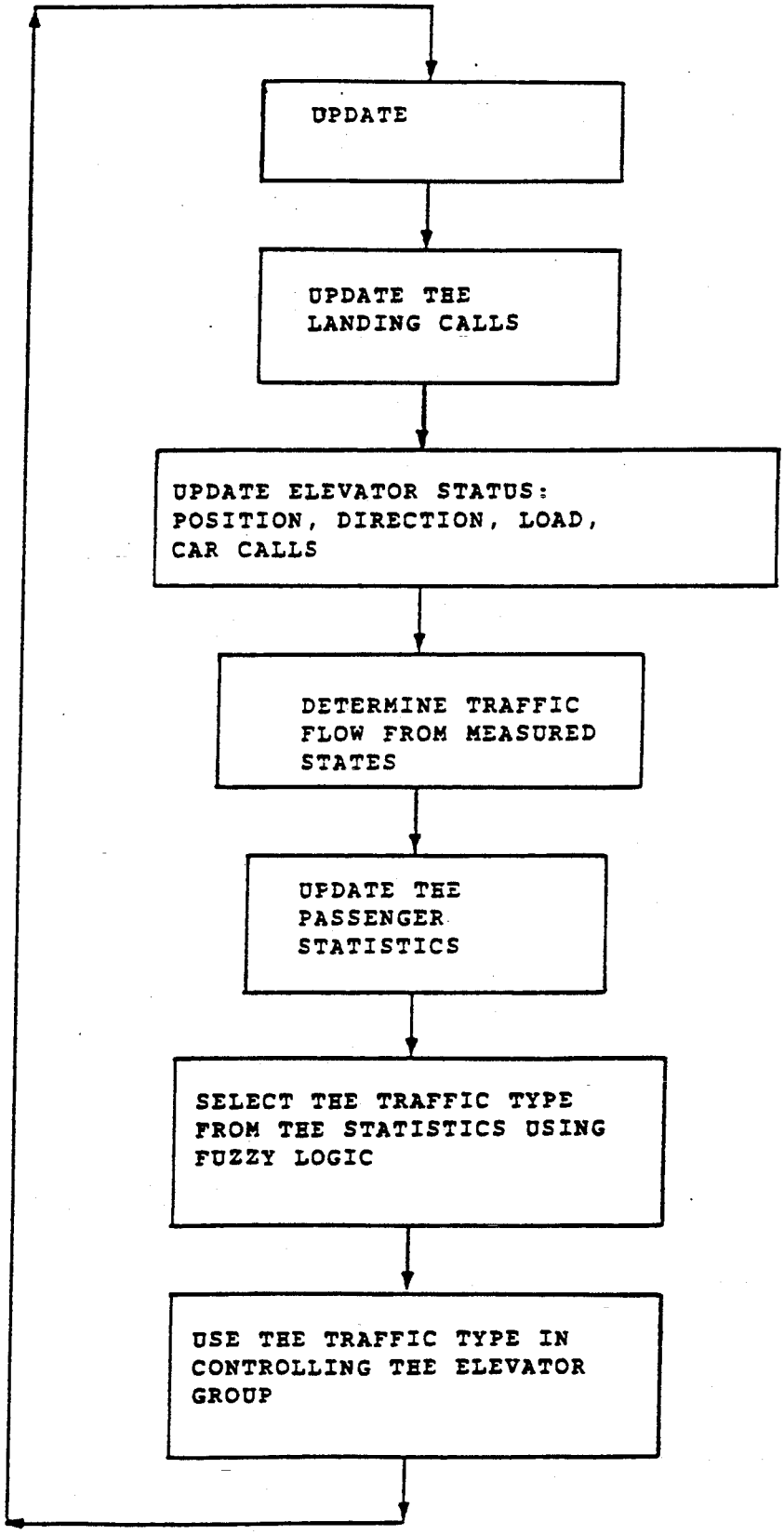
FIG. 2 is a flow diagram representing the succession of operations according to the present control method.

FIG. 2 shows a more detailed block diagram of the various stages of the group control procedure. The traffic statistics are stored separately for each day of the week in the memory unit used by the group control in the method of the present invention. Therefore, during group control the memory has to be updated, i.e. it has to know the current day of the week and the time as well as the prevailing operational situation of the elevators, i.e. the numbers of landing calls, the car positions and running directions, the loads of the elevator cars and the car calls. From these data, the control system determines the number of passengers entering and leaving an elevator on each floor in the up direction and the number of passengers entering and leaving an elevator on each floor in the down direction. Statistics on these four floor-specific components and the volume of passenger traffic are continuously updated.

The assumed traffic flow components to be used in the control are mainly determined from the statistics, and the traffic type used by the control system is selected on the basis of the statistics according to the rules of fuzzy logic. The elevator group is then controlled in accordance with the selected traffic type. Different traffic types are utilized in the control using specific peak traffic services, such as delayed departure of cars from the main entrance floor during an up peak. However, the traffic types are mainly brought into effect via differentiated weighting of calls.

Figure 3:
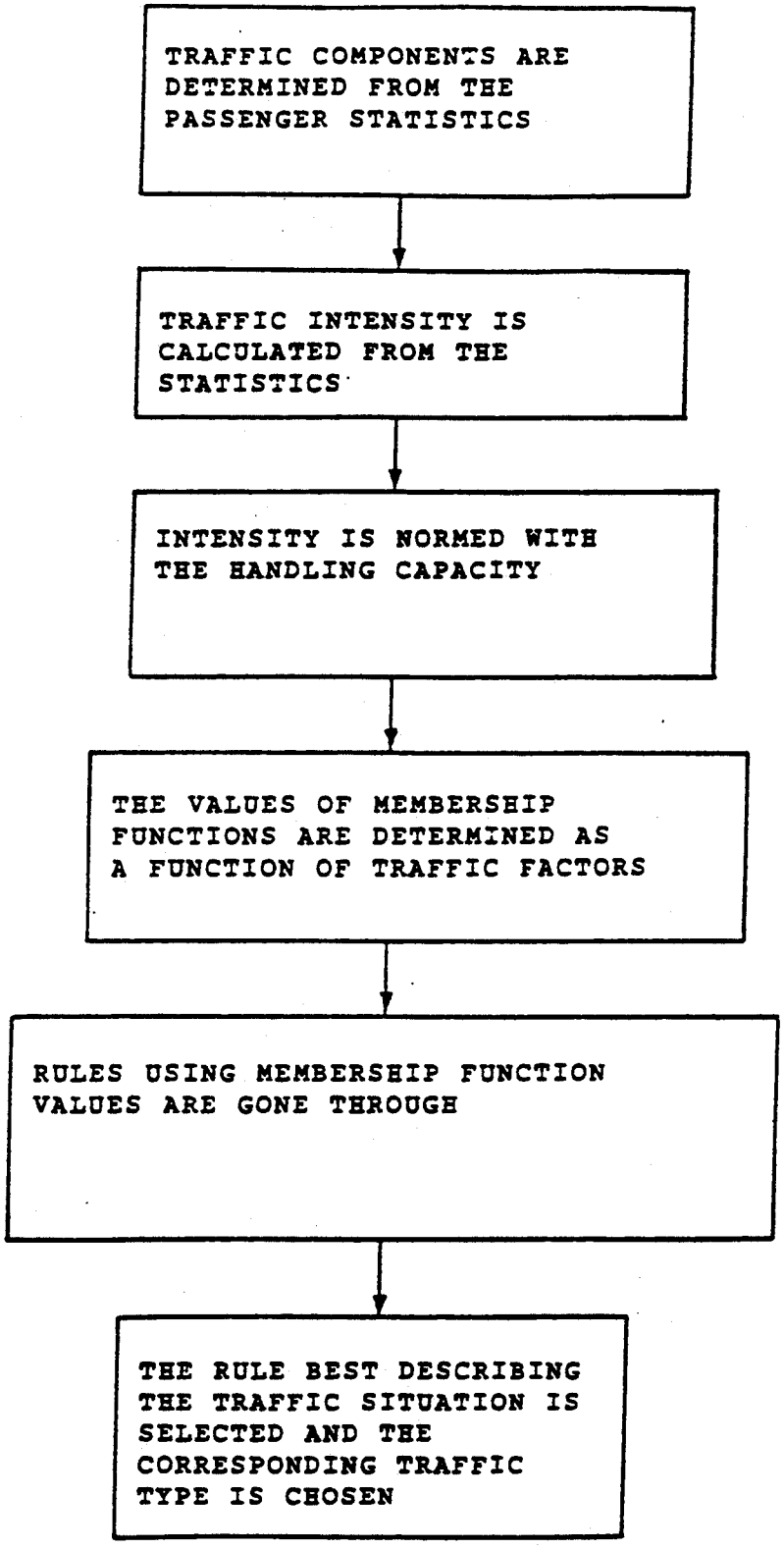
FIG. 3 is a flow diagram illustrating the selection of traffic type according to the method of the invention.

The block diagram in FIG. 3 illustrates the principle of selection of traffic type in the method of the present invention. First, from the statistics available, the control system calculates the current relative proportions of the traffic components, i.e. incoming, outgoing and interfloor traffic, as well as the traffic intensity, jointly termed traffic factors. In addition, the traffic intensity is scaled with respect to the up peak handling capacity of the elevator group, i.e. to the maximum number of passengers that can be transported during incoming traffic. The number of available elevators is always taken into account in the present method. When one of the elevators is out of order for maintenance, the total handling capacity of the group is thus reduced. Consequently, the relative traffic intensity increases and this is taken into account in controlling the whole group.

Next, from the relative proportions of different traffic components and the scaled traffic intensity known on the basis of the statistics, the values for the membership functions corresponding to the traffic factors are determined. The membership functions are described in greater detail in connection with FIGS. 5 and 6. The membership function values are obtained for the various combinations of membership function values, i.e. rules, corresponding to different traffic types, whereupon, based on the values assigned to the various components of the rules, the rule best describing the prevailing passenger traffic situation is selected. Since each rule corresponds to a certain group control strategy, after the selection, the elevator group is controlled in accordance with the strategy corresponding to the selected rule.

In the following, the method of the invention for the control of elevator groups is analyzed in detail by referring to Table 1 and FIGS. 4 to 6.

Figure 4:
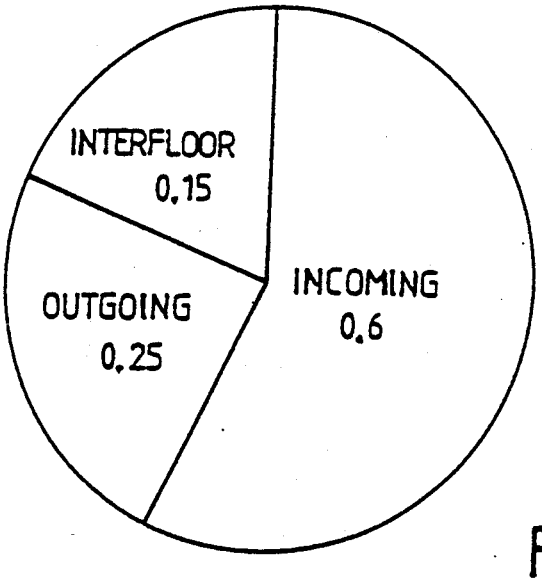
FIG. 4 is a pie chart illustrating the division of the traffic situation into components.

For an elevator group controlled using the method of the invention, the current percentages of the incoming, outgoing and inter-floor traffic components are calculated from the stored statistical traffic data, e.g. as illustrated by FIG. 4. Next, the current statistical traffic intensity is scaled with respect to the currently available handling capacity of the elevator group. After this, the incoming, outgoing and inter-floor traffic components are each divided into three subcategories termed LOW, MEDIUM, HIGH and the intensity is similarly divided into three categories according to its degree, i.e. LIGHT, NORMAL, HEAVY. From these, rules as exemplified by Table 1 are formed.

Figure 5:
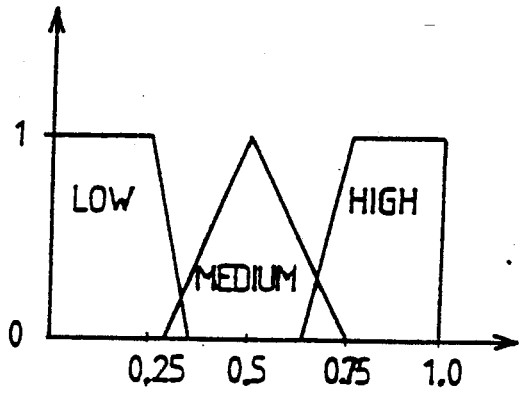
FIG. 5 represents the membership functions of the traffic components.
Figure 6:
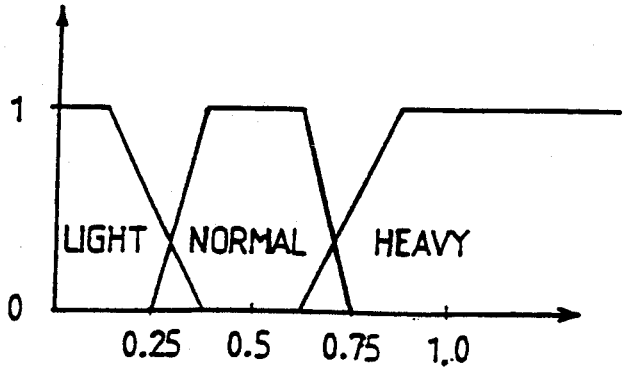
FIG. 6 represents the membership functions of the traffic intensity.

The group control employs membership functions, i.e. assumptions describing different traffic factors, as illustrated by FIGS. 5 and 6. If it is assumed, for example, that the category of traffic intensity is HEAVY (FIG. 6) and if the relative intensity value obtained from the statistics is 0.9, then the membership function has the value of 1, which means that the assumption is completely valid. If the relative intensity value obtained from the statistics is e.g. 0.3, then the value of the membership function is 0 for the assumption HEAVY, which means the assumption is completely invalid. If the intensity value is e.g. 0.75, then the value of the membership function is about 0.4, which means that the assumption has some but not a full degree of validity.

It is to be noted that the curves representing membership functions are not necessarily straight vertical lines between the values 0 and 1. Linearly increasing probabilities of the categories will eliminate drawbacks associated with abrupt divisions between categories. An essential feature of different membership functions is that the membership functions describing the same factor in different categories partially overlap as exemplified by FIGS. 5 and 6. This ensures that the transition from one traffic type to another will not be abrupt and sudden as in currently used control methods.

Next, let us consider rule 4 as an example. Assume that the intensity is 0.7. Since the intensity according to rule 4 is HEAVY (see Table 1), the assumption "intensity HEAVY" is assigned the value of 0.2 from FIG. 6. Our next assumption is that INCOMING is MEDIUM, and according to FIG. 4 INCOMING is 0.6. From FIG. 5, we can see that at the level of 0.6 the assumption has the value of about 0.7. A third assumption is that OUTGOING is LOW, and FIG. 4 shows that the proportion of outgoing traffic is 0.25. Thus, we can see from FIG. 5 that the assumption has the value of 1. A fourth assumption is that INTERFLOOR is LOW, which according to FIG. 4 is 0.15, so that the assumption has the value of 1 as determined from the graph in FIG. 5. Thus, the factors of rule 4 have the values 0.2, 0.7, 1, 1.

Let us consider two more rules, no. 13 and no. 22, as part of our example. In these rules, the intensity is NORMAL and LIGHT respectively, while the rest of the traffic factors are the same as in rule 4. For rule 13, the value of the first membership function is found to be 0.5, and for rule 22, 0.

After this, the rule which best describes the prevailing traffic situation is selected. Using Zadeh's AND operator, the selection is performed firstly by determining the smallest component of each rule i.e.:

rule 4 min (0.2; 0.7; 1; 1)=0.2
rule 13 min (0.5; 0.7; 1; 1)=0.5
rule 22 min (0; 0.7; 1; 1)=0

The preferred one among these three rules is the one whose smallest component has the highest value, i.e. max (0.2; 0.5; 0)=0.5, which corresponds to rule 13. Therefore, the elevator group would in this case be controlled in accordance with rule 13. In practice, all 27 rules are considered in the manner described, whereupon the first rule whose smallest component has the highest value is selected and subsequently applied in the group control.

TABLE 1

| | List of the traffic rules | | | | |
|---|---|---|---|---|---|
| | INTENSITY | INCOMING | OUTGOING | INTERFLOOR | TRAFFIC TYPE |
| 1 | HEAVY | HIGH | LOW | LOW | HEAVY UP PEAK |
| 2 | " | LOW | HIGH | LOW | HEAVY DOWN PEAK |
| 3 | " | LOW | LOW | HIGH | HEAVY INTERFLOOR |
| 4 | " | MEDIUM | LOW | LOW | HEAVY INCOMING |
| 5 | " | LOW | MEDIUM | LOW | HEAVY OUTGOING |
| 6 | " | LOW | LOW | MEDIUM | HEAVY INTERFLOOR |
| 7 | " | MEDIUM | MEDIUM | LOW | HEAVY TWO WAY |
| 8 | " | MEDIUM | LOW | MEDIUM | HEAVY MIXED |
| 9 | " | LOW | MEDIUM | MEDIUM | HEAVY MIXED |
| 10 | NORMAL | HIGH | LOW | LOW | NORMAL UP PEAK |
| 11 | " | LOW | HIGH | LOW | NORMAL DOWN PEAK |
| 12 | " | LOW | LOW | HIGH | NORMAL INTERFLOOR |
| 13 | " | MEDIUM | LOW | LOW | NORMAL INCOMING |
| 14 | " | LOW | MEDIUM | LOW | NORMAL OUTGOING |
| 15 | " | LOW | LOW | MEDIUM | NORMAL INTERFLOOR |
| 16 | " | MEDIUM | MEDIUM | LOW | NORMAL TWO WAY |
| 17 | " | MEDIUM | LOW | MEDIUM | NORMAL MIXED |
| 18 | " | LOW | MEDIUM | MEDIUM | NORMAL MIXED |
| 19 | LIGHT | HIGH | LOW | LOW | LIGHT INCOMING |
| 20 | " | LOW | HIGH | LOW | LIGHT OUTGOING |
| 21 | " | LOW | LOW | HIGH | LIGHT INTERFLOOR |
| 22 | " | MEDIUM | LOW | LOW | LIGHT INCOMING |
| 23 | " | LOW | MEDIUM | LOW | LIGHT OUTGOING |
| 24 | " | LOW | LOW | MEDIUM | LIGHT INTERFLOOR |
| 25 | " | MEDIUM | MEDIUM | LOW | LIGHT TWO WAY |

TABLE 1-continued

| | | List of the traffic rules | | |
|---|---|---|---|---|
| | INTENSITY | INCOMING | OUTGOING | INTERFLOOR | TRAFFIC TYPE |
| 26 | " | MEDIUM | LOW | MEDIUM | LIGHT MIXED |
| 27 | " | LOW | MEDIUM | MEDIUM | LIGHT MIXED |

The selected traffic type mainly affects the weighting of the landing calls. For instance in the case of two-way traffic type, more weight is applied to down-calls issued from above the main entrance floor and up-calls issued from the entrance floor. In heavy intensity conditions, the weighting may be e.g. three-fold in relation to other landing calls.

It is to be noted that in the above example the traffic situation is divided into three different components, and these components and the traffic intensity are divided into three subcategories. However, this is only one principle of division which has been found to be a good one, but in the method of the invention these divisions can be made in any manner depending on the requirements in each case.

In the foregoing, the invention has been described in detail by referring to a preferred solution, but different embodiments of the invention are possible within the scope of the idea of the invention as defined in the following claims.

We claim:

1. A method for controlling an elevator group of a building according to a preferred traffic rule, based on recognition of a current traffic pattern, wherein said elevator group is provided with a group control and a plurality of elevator controls, said method comprising the following steps:

(a) continuously measuring, collecting and updating traffic data obtained with a plurality of floor and car detector devices, and forming in a memory unit of the elevator group control a statistical data base for the elevator group, said statistical data base comprising said traffic data grouped on a daily basis at predetermined moments of time;

(b) defining as traffic factors at least two traffic components describing the traffic flow direction and position in the building and a traffic flow direction and position in the building and a traffic intensity, generating and storing in said memory unit a set of membership functions of the traffic factors and a standard set of traffic rules for the elevator group, and continuously calculating and updating said traffic factors from the updated statistical data base and storing said updated traffic factors in the memory unit, grouped at said predetermined moments of time;

(c) determining a current value for each of said traffic factors from said updated traffic factors and determining a fuzzy value for each of said current traffic factor, by use of said set of membership functions;

(d) substituting said fuzzy values into each of said traffic rules defined in step (b) to obtain a current set of traffic rules;

(e) assigning fuzzy values to said current traffic rules according to said traffic factors and said membership functions;

(f) selecting said preferred traffic rule according to a preset interpretation of a best traffic rule describing the current traffic situation; and (g) processing said preferred traffic rule into said elevator group control and monitoring said plurality of elevator controls in accordance with the current traffic data and said preferred traffic rule.

2. A method as claimed in claim 1, wherein said preferred traffic rule is selected from the following steps:

(i) assigning to each traffic rule of said current set of traffic rules a value equal to a lowest traffic factor of the respective traffic rule, and (i) selecting said preferred traffic rule to have the highest value.

3. A method as claimed in claim 1 or 2, wherein the traffic components comprise an incoming, an outgoing and an interfloor traffic component, so that each traffic rule comprises four variables.

4. A method as claimed in claim 1 or 2, wherein said traffic intensity is dynamically scaled with respect to the current handling capacity of the elevator group.

5. A method as claimed in claim 1 or 2, wherein the statistical data base is updated by continuously storing data obtained from load weighing devices destination buttons and elevator car status detectors of each elevator car of said elevator group.

6. A method as claimed in claim 5, wherein a number of passengers leaving and a number of passengers entering the elevator car on a given floor is calculated from the elevator car load data during a stop at the floor, the number of new car calls, photocell signals and hall and destination call data.

7. A method as claimed in claim 1 or 2, wherein the traffic intensity is divided into three membership functions according to its degree: light, normal and heavy.

8. A method as claimed in claim 1 or 2, wherein each of said traffic components is divided into three membership functions: low, medium and high.

9. A method as claimed in claim 1 or 2, wherein said statistical data base further comprises the information supplied by a lobby detector giving the number of passengers waiting for an elevator.

* * * * *